US007140902B2

(12) United States Patent
Burton

(10) Patent No.: US 7,140,902 B2
(45) Date of Patent: Nov. 28, 2006

(54) SECURING DEVICE AND METHOD

(75) Inventor: John E Burton, Ludington, MI (US)

(73) Assignee: Burton Technologies, LLC, Ludington, MI (US)

( * ) Notice: Subject to any disclaimer, the term of this patent is extended or adjusted under 35 U.S.C. 154(b) by 0 days.

(21) Appl. No.: 11/188,340

(22) Filed: Jul. 25, 2005

(65) Prior Publication Data

US 2005/0255738 A1 Nov. 17, 2005

Related U.S. Application Data

(62) Division of application No. 10/706,602, filed on Nov. 12, 2003, now Pat. No. 6,948,963, which is a division of application No. 09/795,664, filed on Feb. 28, 2001, now Pat. No. 6,676,428.

(51) Int. Cl.
*H01R 13/625* (2006.01)
*H01R 13/15* (2006.01)

(52) U.S. Cl. ..... 439/347; 439/265

(58) Field of Classification Search ..... 439/346, 439/264, 265, 347, 268, 269, 345
See application file for complete search history.

(56) References Cited

U.S. PATENT DOCUMENTS 2,261,615 A * 11/1941 Cornwell ..... 439/265
2,436,586 A 2/1948 Mangold
3,891,291 A 6/1975 Nadsady et al.
3,945,702 A 3/1976 Poliak et al.
4,183,603 A 1/1980 Donarummo
4,184,732 A 1/1980 Hudson
4,204,738 A 5/1980 Tillotson
4,221,449 A 9/1980 Shugart, Jr.
4,440,465 A 4/1984 Elliott et al.
4,457,571 A 7/1984 Lavine et al.
4,514,026 A 4/1985 Herbert
4,605,273 A 8/1986 Horton
4,627,681 A * 12/1986 Hong ..... 439/370
4,652,069 A 3/1987 Smith
4,687,271 A 8/1987 Szoboszlai et al.
4,726,780 A 2/1988 Thackeray
4,832,618 A 5/1989 Gunderson (Continued)

OTHER PUBLICATIONS

Photographs of Woods brand electrical cord—date of manufacture unknown.

*Primary Examiner*—Hien Vu
(74) *Attorney, Agent, or Firm*—Brian G. Gilpin; Godfrey & Kahn, S.C.

(57) ABSTRACT

The connector is capable of securing a cord to an outlet, of securing extension cords, and/or of securing an extension cord to the cord of a power tool. The device may have a female receptacle and a male plug, only a female receptacle, or only a male plug. The female receptacle may have a screw-style plunger, a sleeve-style plunger, or other means for applying pressure against the sleeves holding the prongs that are plugged into the receptacle. The male plug can use a sleeve-style plunger or other means to apply pressure against at least one of the prongs, causing the plug to be clamped into a receptacle. The female receptacle and male plug of the device can be separated by a cord to create an extension cord. The female receptacle or male plug could also be placed on the cords of a tool or appliance. A plurality of female receptacles could be used in a single unit to create a power strip having locking receptacles.

4 Claims, 13 Drawing Sheets

U.S. PATENT DOCUMENTS 4,907,985 A 3/1990 Johnsen
4,909,749 A * 3/1990 Long ..... 439/263
4,957,450 A 9/1990 Pioszak
4,981,441 A 1/1991 Ignasiak
5,046,961 A 9/1991 Hoffman
5,104,335 A 4/1992 Conley et al.
5,108,301 A 4/1992 Torok
5,133,671 A 7/1992 Boghosian
5,197,897 A * 3/1993 Torok ..... 439/263
5,234,355 A 8/1993 Sosinski et al.
5,328,384 A 7/1994 Magnuson
5,336,103 A * 8/1994 Herboldsheimer ..... 439/346
5,336,107 A 8/1994 Sheryll
5,393,243 A 2/1995 Carmo
5,423,693 A 6/1995 Light
5,443,397 A 8/1995 Carl
5,470,249 A 11/1995 Mangenello
5,551,884 A * 9/1996 Burkhart, Sr. ..... 439/140
5,582,524 A 12/1996 Sanner et al.
5,584,720 A 12/1996 Elswick
5,593,312 A 1/1997 McCracken
5,628,646 A 5/1997 Voss
5,655,924 A 8/1997 Cross et al.
5,685,732 A 11/1997 Lane
5,732,445 A 3/1998 Stodolka et al.
5,752,848 A 5/1998 Youngmark
5,755,588 A 5/1998 Sweatman et al.
5,782,649 A 7/1998 Aiken
5,803,750 A 9/1998 Purington et al.
5,893,772 A * 4/1999 Carmo et al. ..... 439/346
5,913,692 A 6/1999 Targett
5,931,702 A 8/1999 Fladung
5,941,724 A 8/1999 Reed
5,967,849 A 10/1999 Shiga et al.
6,010,350 A 1/2000 Henrici et al.
6,012,940 A 1/2000 Wheeler
6,033,251 A 3/2000 Cook
6,039,591 A 3/2000 Marsh et al.
6,080,004 A 6/2000 Kovacik et al.
6,099,341 A 8/2000 Shymko
6,135,803 A 10/2000 Kovacik et al.
6,171,129 B1 1/2001 Phillips
6,190,180 B1 2/2001 Purington et al.
6,428,339 B1 8/2002 Davidson et al.

* cited by examiner

SECURING DEVICE AND METHOD

CROSS REFERENCE TO PRIOR APPLICATION

This application is a divisional application and claims priority to U.S. patent application Ser. No. 10/706,602 filed on Nov. 12, 2003, now U.S. Pat. No. 6,948,963 issued Sep. 27, 2005, which is a divisional application claiming priority to U.S. patent application Ser. No. 09/795,664 filed on Feb. 28, 2001, now U.S. Pat. No. 6,676,428 issued Jan. 13, 2004, the disclosures of which are incorporated herein by reference in their entirety for all purposes.

FIELD OF THE INVENTION

This invention relates generally to a securing device, and more particularly to a cord securing device that guards against accidental or inadvertent disconnection of connected electrical cords and the like.

BACKGROUND OF THE INVENTION

In many industrial and commercial environments, it is often useful to serially connect a number of electrical extension cords, or to connect an extension cord to an electrical device. In the home or office environment, plugs of electrical power cords for equipment such as vacuum cleaners, electric-powered lawn mowers, drills, lights, computers, and the like, are often coupled to receptacles and/or extension cords. The friction connections between coupling prongs of the plugs and the blades of the receptacles vary greatly and generally will not hold the cords together against anything more than moderate separation tugs. Similarly, in the commercial or industrial environment, tools are commonly connected by extension cords. At construction sites, these cords are often exposed to dust, mud and moisture and may be subject to significant separation tugs.

The inadvertent complete or partial separation of a plug from a socket is not only annoying, but can be dangerous. Particularly in industrial and commercial environments, if the plug and socket combination inadvertently disengages during use, such disconnection can cause down time and a potential safety hazard depending on the type of equipment the power was cut off from. Even if partial separation occurs, a short circuit could occur and result in a fire or shock.

Carpenters and others have often attempted to solve this separation problem by tying two cords together in a knot. This method is unsafe because it can weaken or break one or both of the cords at the cord ends, creating an electrical hazard. Additionally, knots snag when moving cords around corners and other objects. Tape has also been used to hold cords together. Although somewhat effective, it is often messy because it leaves a residue of adhesive on the connectors after the tape has been removed, and does not allow for quick or easy disconnection. Thus, different types of clips have been developed for securing two cords together, such as the ones disclosed in U.S. Pat. No. 6,012,940 to Wheeler, and U.S. Pat. No. 4,183,603 to Donarummo. These clips are generally a unitary piece of plastic that clips around each cord. However, such clips cannot be used to connect a power cord to an electrical outlet on a wall, are cumbersome, and not very effective in preventing partial separation.

A number clamps have also been developed for securing a power cord to an extension cord, such as the ones disclosed in U.S. Pat. No. 6,135,803 to Kovacik et al.; U.S. Pat. No. 5,732,445 to Stodolka, et al.; U.S. Pat. No. 5,328,384 to Magnuson; and U.S. Pat. No. 4,957,450 to Pioszak. Relatively simple clamps are generally constructed of a plastic strip that is held together with a hook-and-loop material or snap-fit. However, such devices become useless once the hook and loop material becomes too dirty to provide a reliable bond. Relatively complex clamps are generally constructed of two parts that lock together with a screw mechanism. While such clamps may be more reliable for some uses, they still have the drawback of being difficult to use if they become dirty. At construction sites, power cords often lay on the bare ground and can become caked with dirt and mud. Even if they remain clean, these clamps are often time consuming to attach and require manipulation of several parts, making them complicated to manufacture and difficult to use. Further, some of these clamping devices only work if they are attached to the cords during the manufacturing stage of the cord itself. Others must be detached from the cords if not in use, and therefore need to be moved when switching cords from one connection to another.

Devices or adapters with multiple electrical sockets have also been developed in an attempt to solve the inadvertent separation problem, such as the one disclosed in U.S. Pat. No. 5,931,702 to Fladung. The Fladung device can only secure one power cord to one extension cord (i.e. one male connection to one female connection). Thus, if there are five female connections and one male connection, only one female connection and one male connection are secured. Four of the five cords can still be inadvertently separated from the adapter. Further, the device requires the electrical cord to be pulled through an eyelet and wrapped about a post. This presents the same problems as tying a knot in the cord.

Other devices have been developed for securing a plug to an electrical wall outlet, such as the one disclosed in U.S. Pat. No. 4,457,571 to Lavine et al. The Lavine device consists of a cup-like housing that is open on the top and one side. The open side has flanges that slidingly engage slots on the face plate of a wall outlet. However, these devices require permanent attachment to wall outlets, forcing the user to purchase multiple sets. The separate parts for these devices could become lost, and if the housing is left on the receptacle while not in actual use, small children may be tempted to put small toys or liquids into the housing. Further, these devices will not work in conjunction with an extension-cord-to-power-plug connection.

Accordingly, a need exists for an easy to use, compact, and streamlined device that can prevent inadvertent disengagement of a cord from a wall outlet, an extension cord, a power strip, or other connection source.

SUMMARY OF THE INVENTION

The present invention relates to a cord securing device. As described in more detail below, and shown in the accompanying drawings, the cord securing device of the present invention uses mechanical means to apply a clamping force between mating electrical contacts to lock conventional plugs into the female end of one embodiment of the device. This clamping force may be applied by the female end by providing a force against the male prong in any number of directions. For example, in a female device designed to retain a two-pronged male plug, the force could be provided between the two prongs and directed outwardly such that each prong is clamped. Similarly, a clamping force is used to lock the male prongs of another embodiment of the device to a socket. The clamping force may be provided by moving the prongs in any number of directions. For example, in a male device having three prongs, two prongs could be stationary and the third prong forced inwardly toward the two other prongs so as to clamp the prongs in the socket.

The securing device of the present invention may be incorporated into a variety of embodiments. One embodiment is a compact adapter that can be used to lock a conventional power cord to an extension cord, wall receptacle or the like. This embodiment includes a female receptacle combined with a male plug. The adapter has a housing that supports three prongs, i.e. hot, neutral and ground prongs. The hot and neutral receiving prongs include sleeves that are designed to clamp a male plug inserted into the adapter. This "clamping" or locking function is selectively obtained by moving a screw-style plunger against ramps on the side of the receiving prong that engages the prongs of the male plug. The screw-style plunger is generally a screw member that moves within the housing. In this embodiment, the screw-style plunger is accessible from the male side of the adapter and moved by rotating it with a screwdriver or the like. The screw-style plunger pushes against the ramp on each receiving prong thereby pushing them outward. The end of the receiving prong that is on the outside is held in place thereby sandwiching the male plug prong in place. The male portion of the embodiment uses a another type of plunger ("sleeve-style" plunger) to apply pressure against the ground prong. The ground prong has a ramp located on one edge. The sleeve-style plunger slidingly engages the ramp when it is moved by a wheel that is threadingly engaged thereto. When the sleeve-style plunger moves up the ramp, the exposed portion of the ground prong moves downwardly toward the protruding portion of the hot and neutral prongs. This position of the ground plug serves to grip the wall outlet or other receptacle into which the adapter is plugged.

In other embodiments, the female receptacle uses a sleeve-style plunger that is moved by rotating a wheel that surrounds the housing. This is especially useful for devices where it is not easy or possible to access the screw-style plunger from a surface opposite from where the outside plug is inserted. Thus, one embodiment of the present invention is an extension cord where the male portion of the invention is separated from the female portion of the invention by a cord.

Another embodiment of the present invention is a power strip. On the body of the power strip is a row of the female receptacles. Each receptacle can be locked by turning the threaded wheel corresponding to the female receptacle. If desired, the male plug of the present invention is used to connect the power strip to a power source, and is connected to the body by a cord. The power strip may incorporate surge-protecting or power-converting features if desired in a particular application.

The male portion of the present invention can be installed on electric devices as original equipment during manufacture or as a replacement plug by a consumer. Thus, one embodiment of the present invention is a hand tool, such as a drill, that incorporates the male plug of the present invention. Another embodiment of the present invention is an appliance such as a vacuum cleaner that incorporates the male plug of the present invention. Additionally, the male plug or female receptacle can be sold as a kit for replacing conventional plugs and receptacles.

The female receptacle of the present invention that is locked by turning a wheel can also be used in conjunction with various adapters. One such embodiment is an adapter that has one male plug wheel and one female receptacle wheel. The male plug and female receptacle are separated by an elongated housing. Each is locked by turning the separate wheel corresponding thereto, which causes the corresponding plunger to move accordingly. Another such embodiment is a multi-access adapter that has a T-shaped, or other shape housing. In this embodiment, there is one male plug extending from the housing, and at least two other female receptacles extending from the housing.

While the present invention is particularly useful in connecting electrical plugs together, other applications are possible and references to use with power cords and certain electrical devices should not be deemed to limit the application of the present invention. The present invention may be advantageously adapted for use where similar performance capabilities and characteristics are desired. These and other objects and advantages of the present invention will become apparent from the detailed description, claims, and accompanying drawings.

DETAILED DESCRIPTION

Figure 1:
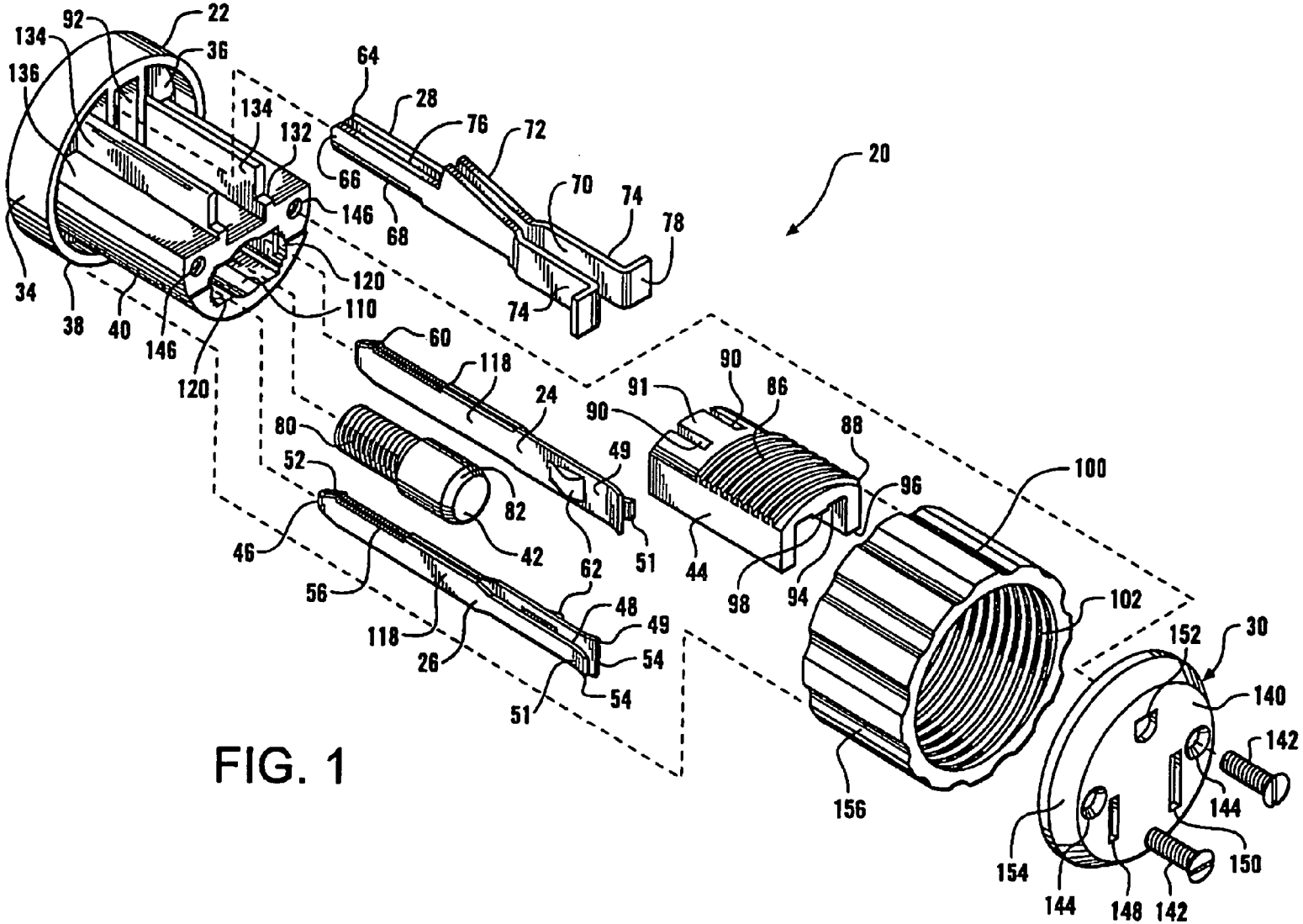
FIG. 1 is an exploded perspective view of the securing device constructed as an adapter in accordance with one embodiment of the present invention.
Figure 3:
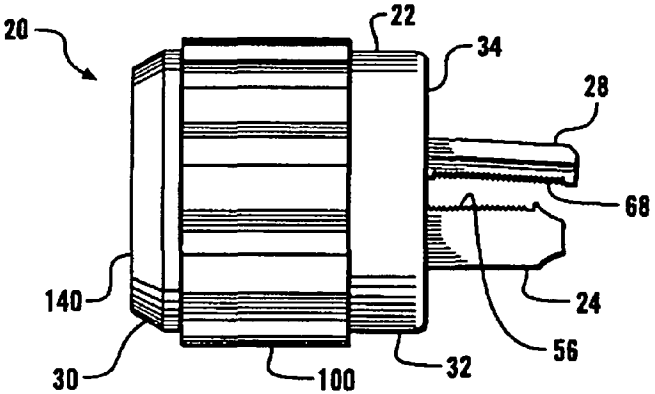
FIG. 3 is a side elevational view of the adapter shown in FIG. 2, in a clamped position.

FIGS. 1 through 9 show a securing device according to one embodiment of the present invention. In this embodiment, the securing device is an adapter that can be used to secure a conventional two- or three-prong power cord to another such cord, or to a wall outlet or the like. This securing device is referred to as adapter 20 in FIGS. 1–9. Adapter 20 is generally constructed from a housing member 22, which supports the three adapter prongs: "hot" prong 24, "neutral" prong 26, and "ground" prong 28. These terms generally refer to the standard configuration of an electrical cord, but the invention could be used in connection with other types of connectors. Housing 22 is made from an electrically non-conductive material such as plastic. As seen in FIGS. 2–5, adapter 20 has a female end 30 that receives outside or conventional prongs, and a male end 32 from which adapter prongs 24, 26 and 28 project.

Referring to FIG. 1, at one end of the housing member 22 is a pan 34. Pan 34 has a substantially circular flat face 36 with cylindrical side walls 38 extending therefrom. Face 36 and walls 38 could be shaped differently, e.g. square, oval, etc. An extension 40 extends from face 36 in the same direction as walls 38. Extension 40 is the primary structural member of adapter 20 as it provides structural support for all of the interior components, such as prongs 24, 26 and 28, a screw-style plunger 42, and sleeve-style plunger 44.

Prongs 24 and 26 operate to complete an electrical circuit, and are thus made of an electrically conductive material, e.g. copper. Preferably, prongs 24 and 26 are made from an elongated metal blank that is stamped out, bent and folded over at its midpoint to form a prong tip 46, and an opposite sleeve 48. Of course, other methods of manufacturing prongs 24 and 26 such as casting could also be used. Prong tip 46 projects outwardly from the male end 32 of adapter 20 and plugs into other electrical receptacles. Tip 46 may have an adjacent beveled edge 52 for easier insertion into a receptacle. Serrations or the like may be cut into prong edge 56 along the portion of prong 24, 26 that projects from housing 22, possibly leaving a small hooked edge 60 located adjacent bevel 52. The serrated edge and/or hook help to provide additional securing force as will become more apparent herein. Prong sleeve 48 is located at the interior of female end 30 for receiving prongs, and it is preferable that sleeve 48 has flanged ends 54 for easier reception of prongs. On the outside of each sleeve 48 is a ramp 62. Ramps 62 are positioned so that they are directly across from one another, and cause the sleeve to deflect should anything come between them. To provide a ramp 62 with additional strength against deformation, the side 49 of sleeve 48 with the ramp may be wider than the side 51 not containing a ramp, as seen in FIG. 1.

Prong 28 operates to ground the circuit completed by prongs 24 and 26. Like prongs 24 and 26, prong 28 preferably has a beveled edge 64 located at its tip 66, and a serrated edge 68 (see FIGS. 1 and 2). Further, a sleeve 70 is located opposite tip 66 to receive a conventional ground prong. Other than these similarities, the shape of prong 28 differs in several ways. There is a male ramp 72 sloping upwardly from the sleeve 70 on an edge opposite that of serrated edge 68. Further, tabs 78 extend at right angles from the end of sleeve 70. Prong 28 is preferably formed from a symmetric metal blank, and folded not at tip 66, but rather along edge 68. Again, other configurations and manufacturing techniques could be used. Preferably, each symmetric side 74 is spaced apart from each other to form a channel 76 therebetween.

Of course, prongs 24, 26 and 28 could be shaped to accommodate round prongs such as those used in most countries outside of the United States, or other shaped prongs as needed could be provided. Prongs 24–28 could also be manufactured by means other than metal stamping/bending.

Figure 6:
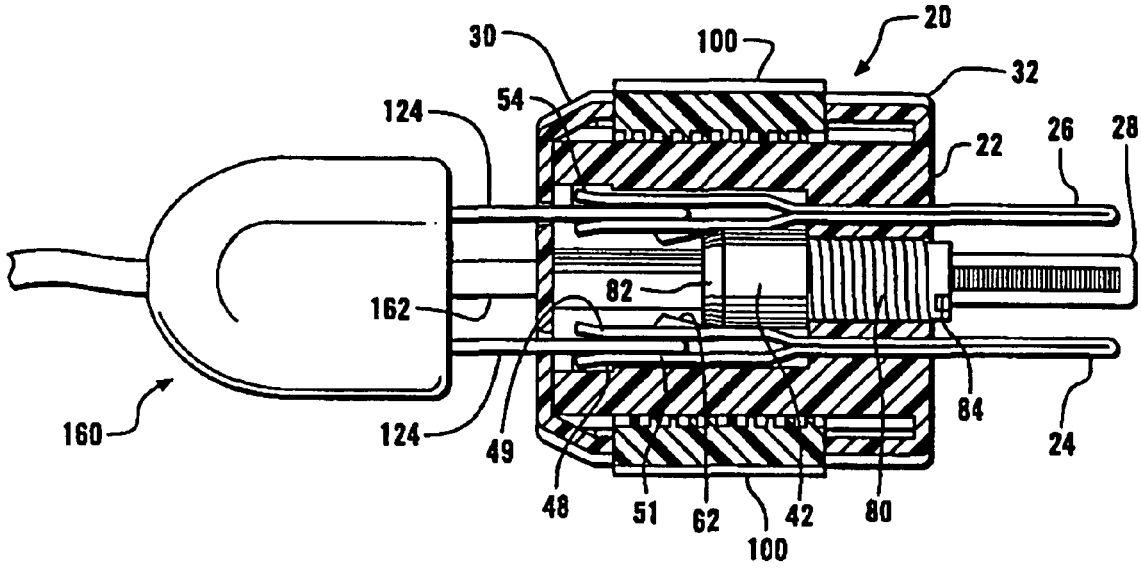
FIG. 6 is a partial cross-sectional top view of a male plug being inserted into the adapter of FIG. 2, taken generally along lines 7—7.

Referring now to FIGS. 1 and 6, screw-style plunger 42 is generally a cylindrical member with a threaded portion 80 at one end, and a beveled edge 82 at an opposite end. A slot 84 or other configuration for receiving a tool is located opposite the beveled end. Rather than a slot 84, other configurations could be used to accommodate a TORX®, Phillips, or another shape of tool head. Screw-style plunger 42 is made from a non-conductive material such as plastic. Preferably, the plastic used is not generally prone to plastic deformation as it moves between ramps 62. Screw-style plunger 42 is not limited to construction from a solid piece of material, and could be constructed from a threaded cylinder that has an electrically-insulated beveled cap at one end for contacting ramps 62.

Figure 5:
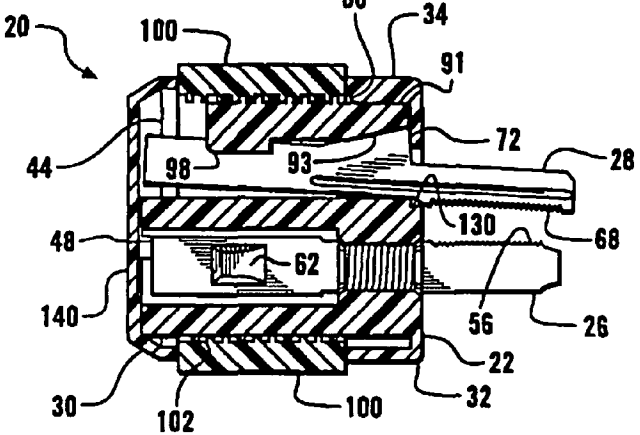
FIG. 5 is a cross-sectional side view of the adapter shown in FIG. 3.
Figure 4:
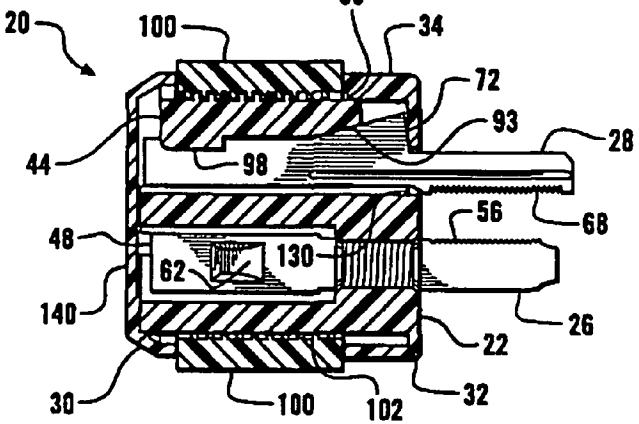
FIG. 4 is a cross-sectional side view of the adapter shown in FIG. 2.

Referring to FIGS. 1 and 4, sleeve-style plunger 44 is generally a C-shaped member of non-conductive material such as plastic. On its top surface 86 are a number of ridges 88 that engage the inner threads 102 of a cylindrical wheel 100. There is also a pair of slots 90 on the top surface for receiving support ribs 92 located on the housing 22. Between slots 90 is a tab 91. The inner surface of the channel is generally rectangular, and defined by the inner surface 94 and sides 96. A spine 98 is located on inner surface 94 and runs along a short length of the center axis of sleeve-style plunger 44, as seen in FIGS. 4 and 5. Spine 98 fits into the channel 76 as it slidingly engages prong 28. A beveled edge 93 is located on the underside of tab 91, also seen in FIGS. 4 and 5. Preferably, the angle of the beveled edge 93 corresponds to the angle of male ramp 72 and the bottom edges 96 contact housing surface 136.

Figure 7:
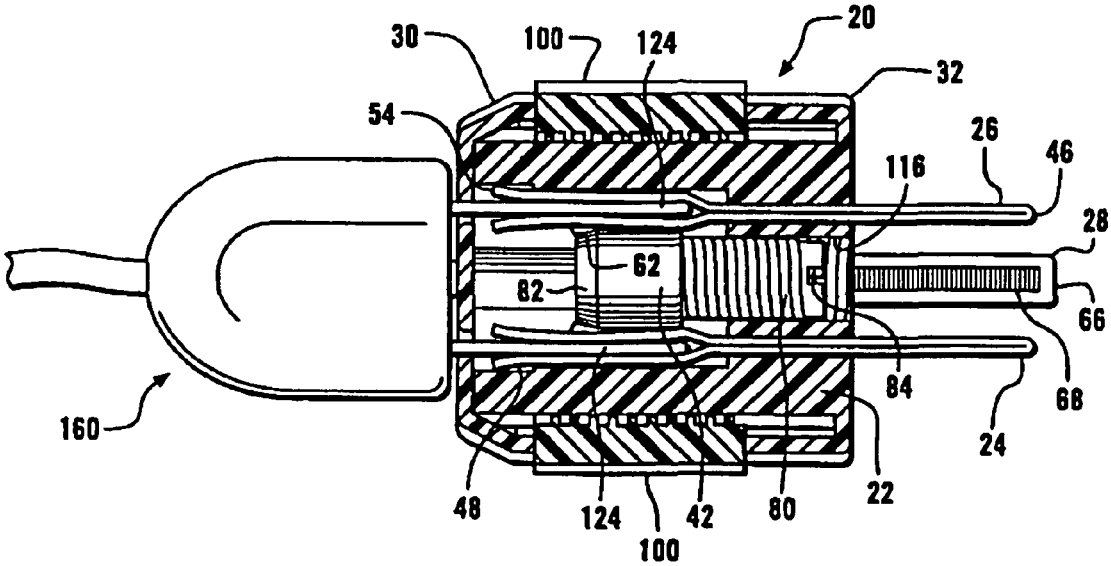
FIG. 7 is a partial cross-sectional top view of a male plug fully inserted into the adapter of FIG. 6 and locked therein.
Figure 8:
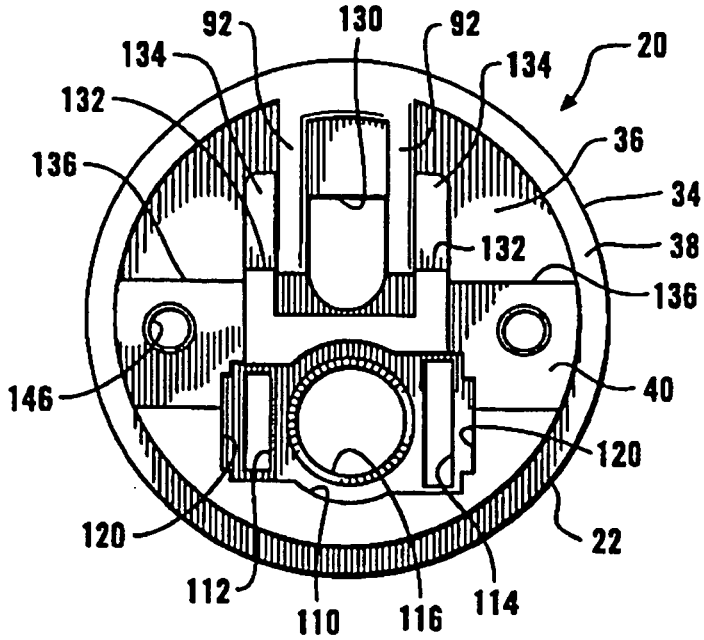
FIG. 8 is an interior view of the housing from the female end of the adapter shown in FIG. 2.
Figure 9:
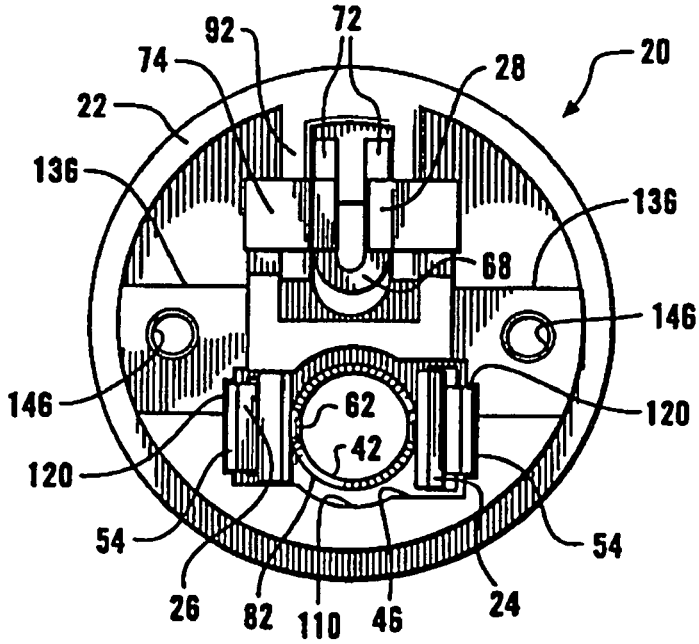
FIG. 9 is an interior view of the housing shown in FIG. 8, and further including hot, neutral and grounding prongs.
Figure 12:
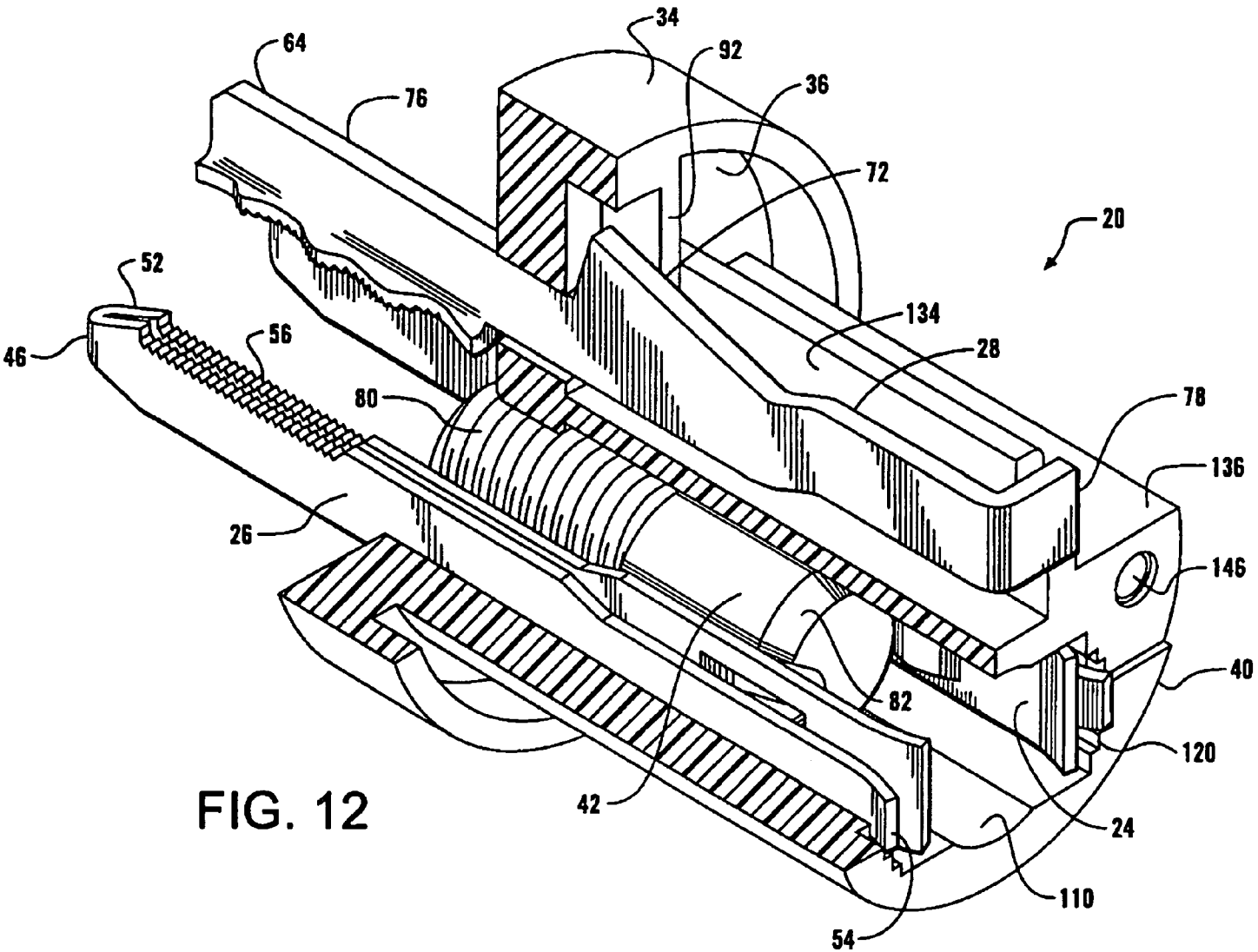
FIG. 12 is a partial cut-away perspective view of the housing shown in FIG. 9.

The shape of housing extension 40 is governed by the components just described. As seen in FIGS. 1 and 8, extension 40 has a cavity therein defined by surface 10. At the very end of this cavity is the face 36 in which there is three apertures, 112, 114 and 116. Prongs 24 and 26 extend through apertures 112 and 114, which are sized to accommodate the center portion 118 of each prong 24, 26. At the other end of extension 40, recesses 120 are located on opposite sides of the cavity to accommodate the flange 54 on each sleeve 48. For example, FIGS. 9 and 12 show prongs 24 and 26 fitted into the cavity, with sleeves 48 resting in recesses 120. Aperture 116 is located between apertures 112 and 114, and is threaded to engage the threads 80 on female screw-style plunger 42. FIGS. 6 and 9 show screw-style plunger 42 in a position where it is not engaging ramps 62. FIG. 7 shows screw-style plunger 42 engaging ramps 62 so that sleeves 48 are deflected against a conventional prong 124. It is preferable to have a beveled edge 82 engage ramp 62, to thereby reduce any stresses on screw-style plunger 42 that could cause unwanted plastic deformation.

Referring again to FIGS. 1, 8 and 12, there is an aperture 130 for ground prong 28 that is located above apertures 112, 114 to accommodate ground prong 28. Aperture 130 is sized to fit the cross-sectional profile of the male portion of prong 28 so that it does not move from side-to-side, yet is allowed to move downward toward prongs 24, 26. When prong 28 is placed on housing member 22, tabs 78 are seated on a ledge 132 that is cut into rails 134. The body of prong 28 is located between rails 134, and is substantially parallel thereto. FIG. 12 shows a cut-away view of the assembled housing 22, prongs 24–28 and screw-style plunger 42.

Sleeve-style plunger 44 slidingly engages rails 134 at adjacent surfaces 136. Slots 90 allow sleeve-style plunger 44 to move along the full length of rails 134 because it is not hindered by housing support ribs 92 that project from face 36. Support ribs 92 provide structural support to pan 34.

To complete adapter 20 assembly, once prongs 24–28 and screw-style and sleeve-style plungers 42, 44 are placed onto extension 40, wheel 100 is placed over extension 40, and a female end cap 140 secured thereon with a pair of fasteners 142. Preferably, fasteners 142 extend through apertures 144 in end cap 140 to threadingly engage a pair of corresponding threaded apertures 146 in extension 40. There are three apertures 148, 150 and 152 in end cap 140 that correspond to the receiving end of prong 26, prong 24 and prong 28, respectively. Preferably, for ease of use, end cap 140 has a beveled edge 154 to prevent snagging, and wheel 100 has a knurled outer surface 156 for improved grip.

Referring to FIGS. 6 and 7, in operation, two outside prongs 124 are inserted into apertures 148, 150 on the female end cap 140. If the conventional power cord 160 has a ground prong 162, this is inserted into aperture 152 on the female end cap 140. Once the prongs 124 are completely inserted, a hand tool such as a screwdriver or the like is used to turn screw-style plunger 42 so that it moves toward the power cord 160. This movement causes screw-style 42 plunger to apply pressure on female ramps 62, so that prongs 124 are clamped between sides 49 and 51 of sleeves 48. The pressure applied by screw-style plunger 42 applies clamping force between the prongs 124 and 24, 26. The clamping force combined with the high coefficient of friction between the metal components prevents power cord 160 from being inadvertently pulled out of adapter 20. The adapter 20 is now essentially "locked" to power cord 160, and can now be locked to a power receptacle, i.e. on a wall, power strip, appliance or the like. Metal-to-metal contact on both sides combined with the mechanical advantage generated by the threaded connection and the ramp provide substantial pull-out resistance.

Figure 2:
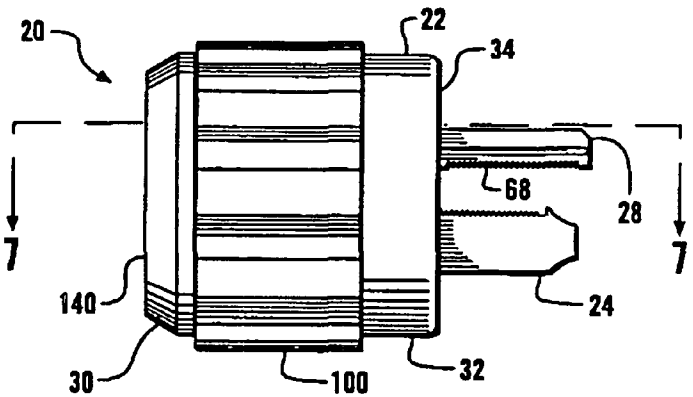
FIG. 2 is a side elevational view of the adapter shown in FIG. 1, in a non-clamped position.

Referring now to FIGS. 2–5, the adapter prongs 24, 26 and 28 are completely inserted into a power receptacle (not shown) such as a wall outlet, extension cord or the like. Prior to "locking" adapter 20 to the electrical receptacle, the prongs 24, 26 and 28 are substantially parallel to each other as seen in FIGS. 2 and 4. For the locking effect, the user turns wheel 100 in a direction that causes sleeve-style plunger 44 to move up the male ramp 72 on prong 28. This causes the exposed portion of prong 28 to move downwardly toward prongs 24, 26, making it difficult to inadvertently pull adapter 20 from the power receptacle to which is it connected. The optional serrated edges 56, 68 on prongs 24, 26 and 28 can increase the holding power of locked adapter 20.

To "unlock" adapter 20 from a receptacle, wheel 100 is turned in an opposite direction to slide the sleeve-style plunger 44 away from male ramp 72. The adapter may now be removed from the receptacle. To remove power cord 160 from adapter 20, screw-style plunger 42 is turned so that it moves away from female ramps 62.

One advantage of adapter 20 is that the motion required to lock a power cord 160 to the adapter 20, or adapter 20 to a receptacle, does not inherently cause the prongs of either device to back out of the adapter 20 or the receptacle. Further, the compact design allows the adapter 20 to be used almost anywhere that a typical power cord can be used. Accordingly, it has been found advantageous to dimension the adapter 20 such that two adapters can simultaneously engage a standard-sized wall outlet.

Figure 10:
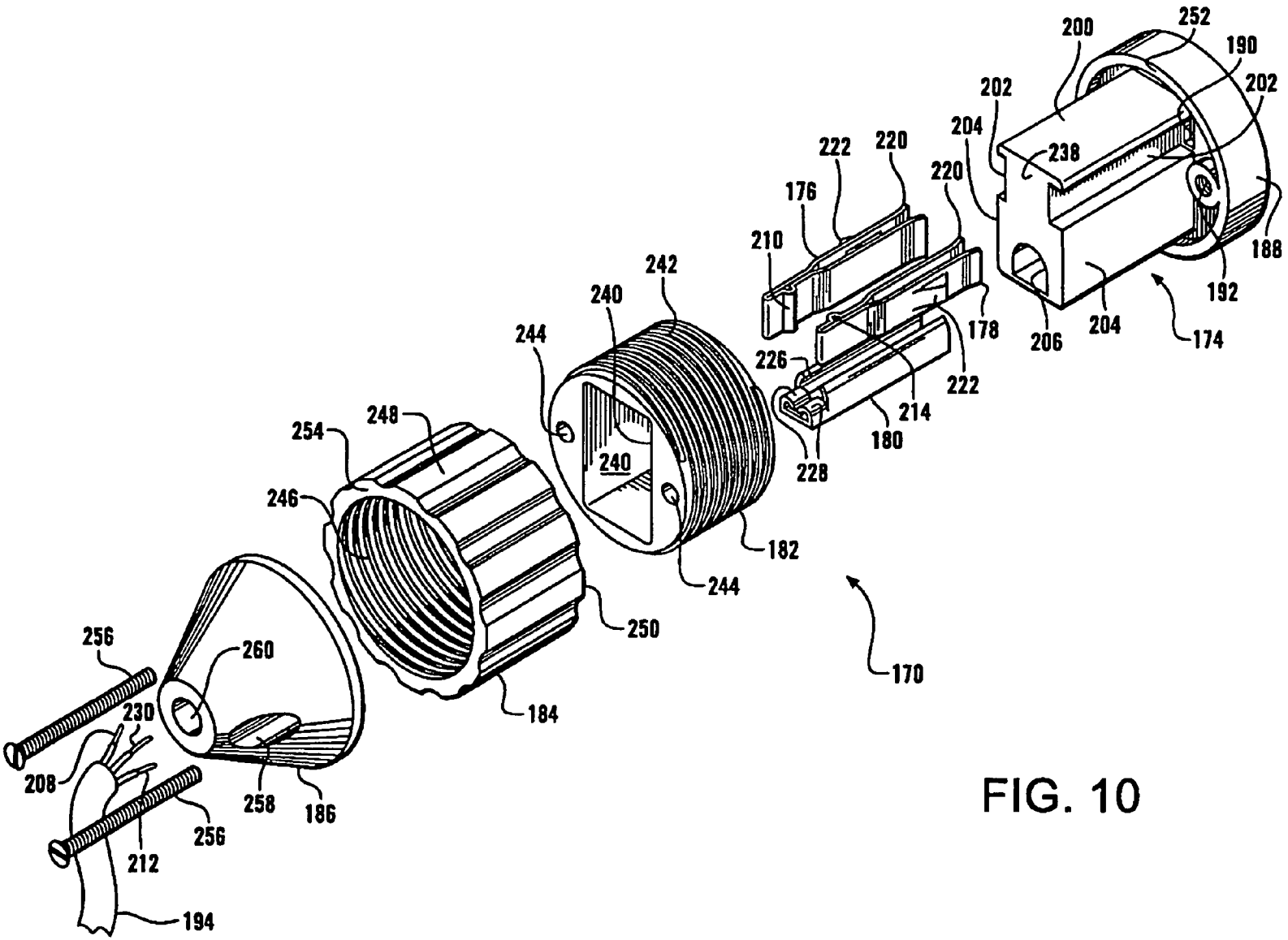
FIG. 10 is an exploded, partial perspective-view of the securement device, constructed as the female receptacle of an extension cord in accordance with one embodiment of the present invention.
Figure 11:
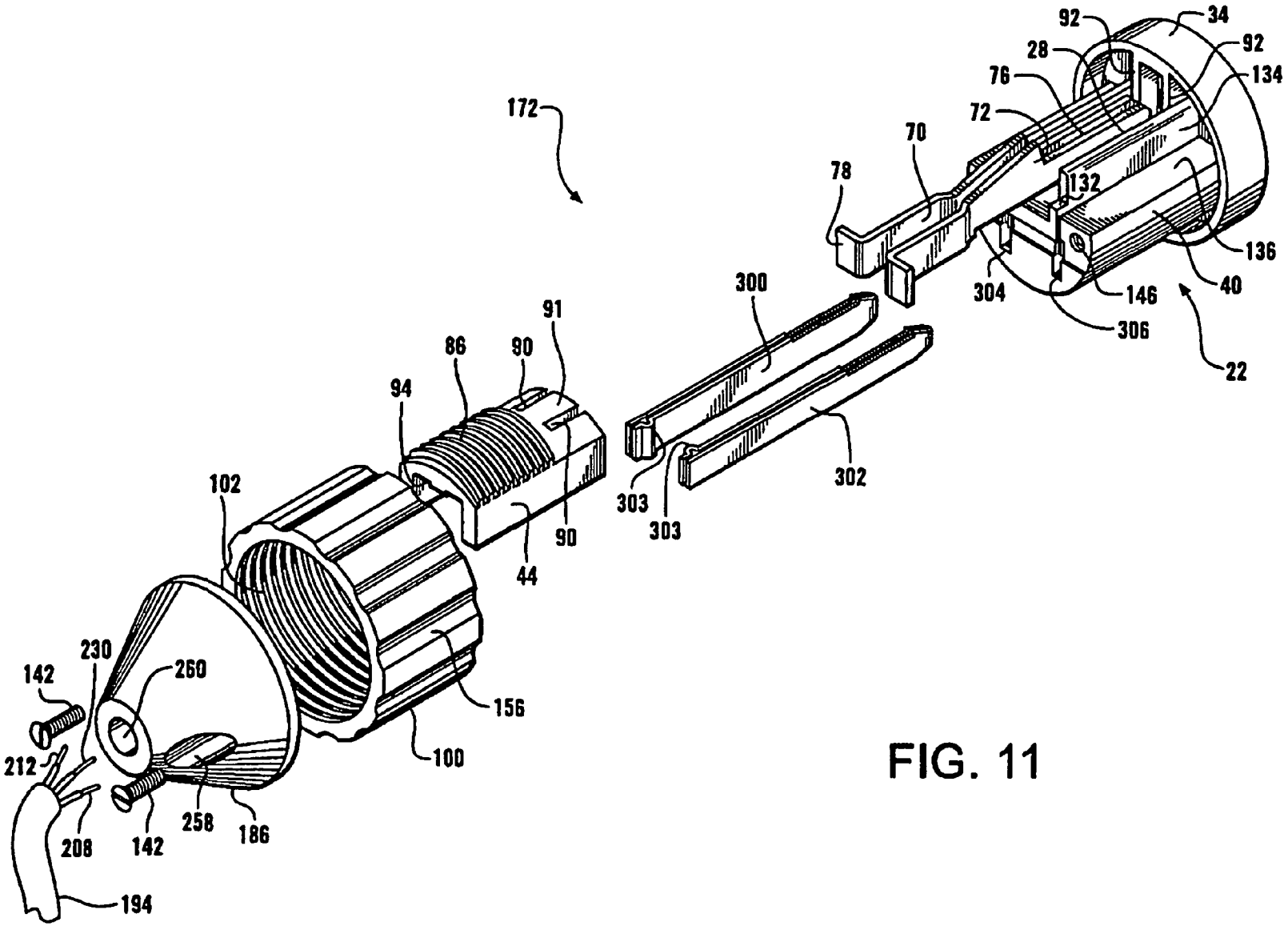
FIG. 11 is an exploded, partial perspective-view of the securement device, constructed as the male plug of an extension cord in accordance with one embodiment of the present invention
Figure 19:
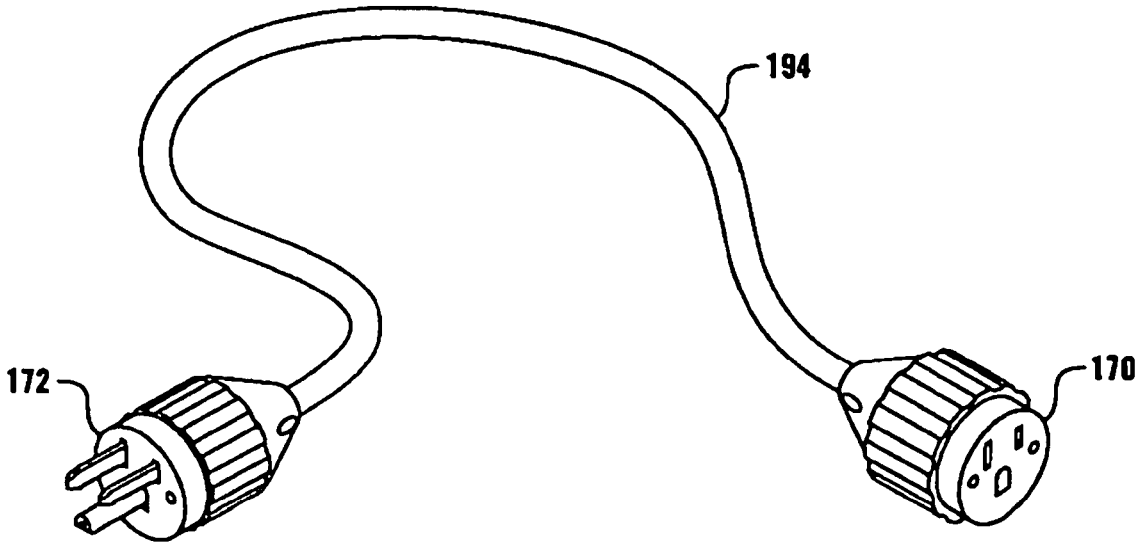
FIG. 19 is a perspective view of the securing device constructed as an extension cord in accordance with one embodiment of the present invention.
Figure 20:
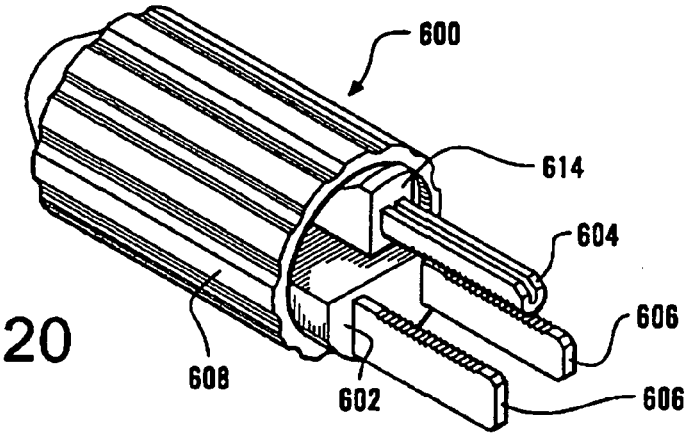
FIG. 20 is a perspective view of an additional embodiment of a securing device in accordance with the present invention.
Figure 21:
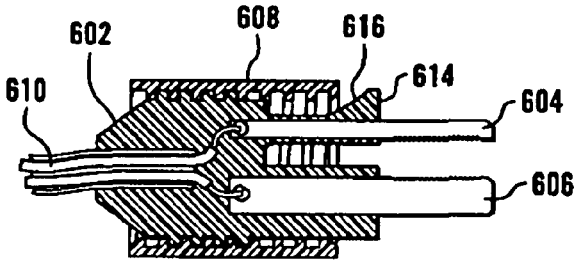
FIG. 21 is a cross-sectional side view of the embodiment of a securing device shown in FIG. 21 in a non-clamped position.
Figure 22:
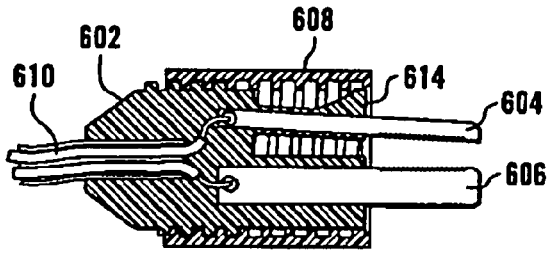
FIG. 22 is a cross-sectional side view of the embodiment of a securing device shown in FIG. 21 in a clamped position.
Figure 23:
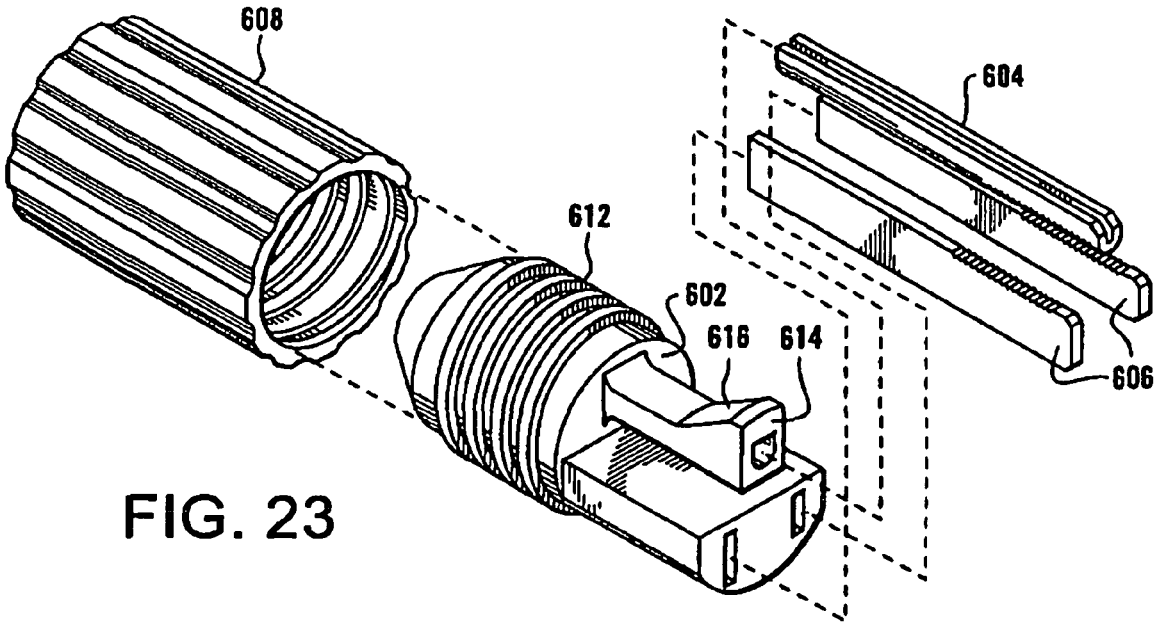
FIG. 23 is an exploded perspective view of the embodiment of a securing device shown in FIG. 21.
Figure 24:
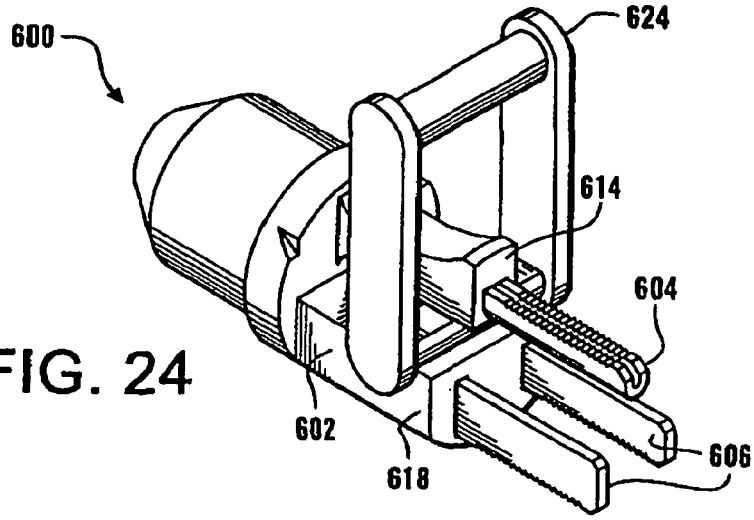
FIG. 24 is a perspective view of another embodiment of a securing device in accordance with the present invention.
Figure 25:
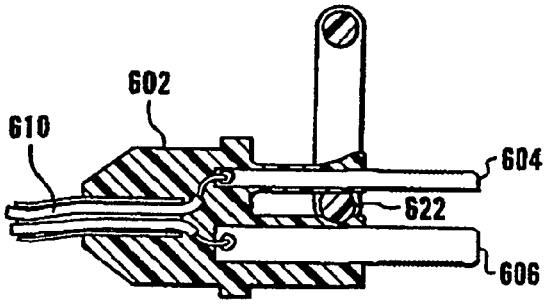
FIG. 25 is a cross-sectional side view of the embodiment of a securing device shown in FIG. 24 in a non-clamped position.
Figure 26:
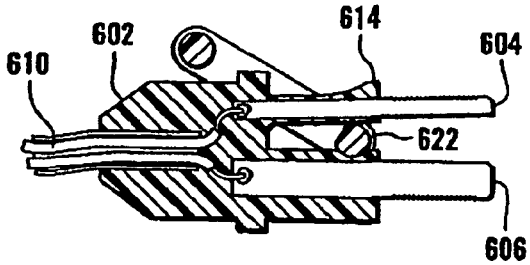
FIG. 26 is a cross-sectional side view of the embodiment of a securing device shown in FIG. 24 in a clamped position.
Figure 27:
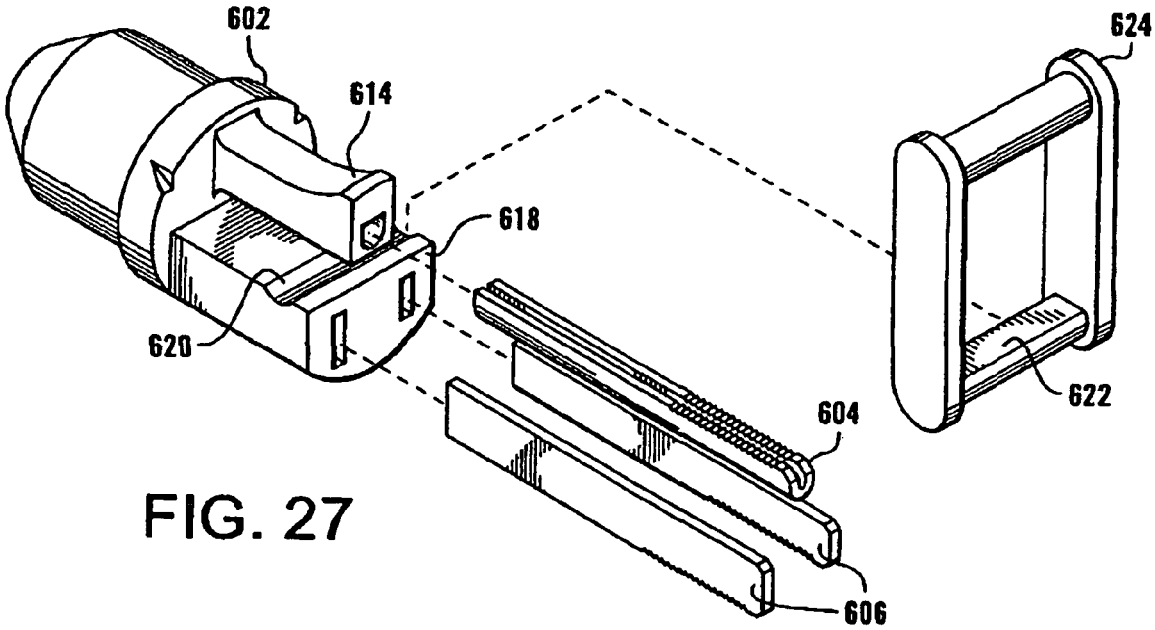
FIG. 27 is an exploded perspective view of the embodiment of a securing device shown in FIG. 24.

In an alternative embodiment, the female portion of adapter 20 is separated from the male portion. Specifically, as seen in FIGS. 11, 12 and 19, a female receptacle 170 and a male plug 172 can be separated by an electrical cord 194 so that the device operates as an extension cord. Preferably, female receptacle 170 is constructed differently than its adapter 20 counterpart so that it is not necessary to access a screw-style plunger with a hand tool as in the previous embodiment. As shown in FIG. 10, female receptacle 170 is constructed from a housing 174; sleeves 176, 178; ground connector 180; slide member 182; wheel 184 and end cap 186. Housing 174 has a pan 188 constructed similarly to pan 34 in the embodiment shown in FIG. 1. The opposite side of pan 188 that cannot be seen in FIG. 10 has five apertures therein, similar to the apertures 144, 148, 150 and 152 found in end cap 140 of the previous embodiment shown in FIG. 1. Two such apertures can be seen from the interior view of FIG. 11, specifically, aperture 190 and threaded aperture 192. An extension 200 extends from the interior side of pan 188. Extension 200 serves to support the sleeves 176, 178, ground connector 180 and slide member 182. Thus, the shape of extension 200 is governed by these components.

Extension 200 is generally a rectangular block that has a pair of channels 202 located on opposite sides 204. Channels 202 accommodate sleeves 176, 178. An aperture 206 extends the length of extension 200 to accommodate the ground connector 180. As before, housing 174 is composed of a non-conductive material such as plastic.

Each sleeve 176, 178 may be manufactured from metal in the manner described for prongs 24, 26 of the embodiment shown in FIGS. 1–9. Unlike prongs 24, 26, sleeves 176, 178 are entirely contained in the housing 174, and hard-wired to the electrical cord 194. Specifically, a "hot" wire 208 is electrically connected to sleeve 176 at a crimp 210, and a "neutral" wire 212 is electrically to sleeve 178 at crimp 214. Alternatively, the wires 208, 212 could be soldered to the sleeves, or otherwise connected to sleeves 176, 178 in another manner such as with screws. As with prongs 24 and 26, sleeves 176 and 178 are preferably flared at the receiving ends 220 so that conventional prongs can be easily inserted into the sleeves. Further, each sleeve 176, 178 has a female ramp 222 located on the outer sides of each sleeve 176, 178. As will be described, the female ramps 222 are selectively engaged by slide member 182.

Ground connector 180 is preferably constructed from stamped sheet metal, although other manufacturing processes can be used such as casting, etc. Sides 226 are bent to conform around a conventional ground prong, which is usually cylindrical in shape and rounded at its insertion end, but could be made to accommodate any shape. At one end, a crimp 228 is placed in each side 226. Ground wire 230 is electrically connected to one or both crimps 228.

Preferably, sleeves 176, 178 are secured within channels 202 and retained so that they cannot move in the direction in which a plug is inserted. Likewise, connector 180 is preferably secured within channel 206. Slide member 182 slidingly engages extension 200, and when the female plug 170 is not locked, slide member 182 does not apply pressure to female ramps 222. The interior side surfaces 240 may be beveled (not shown) on the portion of the surface that contacts female ramps 222, and the exterior surface 242 of slide member 182 is threaded. Apertures 244 extend through the length of slide member, and correspond to pan apertures 192 (only one shown).

Wheel 184 has inner threads 246, and is threaded onto slide member 182 to cause the slide member 182 to move along extension 200 when turned. As with wheel 100, the exterior surface 248 is preferably knurled. When assembled, wheel edge 250 contacts pan edge 252, and end cap 186 contacts wheel edge 254. Wheel 184 is attached to pan 188 by a pair of fasteners 256 that extend through cap apertures 258. The electrical cord 194 extends through center cap aperture 260. Cap 186 is tightened against surface 238 so that wheel 184 can still be turned.

In operation, the user plugs conventional prongs into sleeves 176, 178, and turns wheel 184. Slide member 182 then moves against female ramps 222 to pinch the conventional prongs into the sleeves 176, 178 as described in the previous adapter embodiment of FIG. 1. Wheel 184 is turned in an opposite direction to unlock the female plug 170.

The male plug of the extension cord embodiment is shown in FIG. 11. It is somewhat similar in construction to the male portion of adapter 20 shown in FIGS. 1–9, except there is no screw-style plunger and no need for an extension 40 cavity (defined by surface 110) to accommodate a screw-style plunger 42. The other major difference is the end cap is identical to end cap 186 found on the female receptacle 170. Thus, it also referenced in FIG. 11 as end cap 186. Likewise, the components that are identical or similar to the male portion of adapter 20 in FIG. 11 are labeled with the same reference numbers.

In the embodiment of FIG. 11, prongs 24, 26 are replaced by prongs 300 and 302. Prongs 300, 302 do not need to be shaped to receive a conventional plug since they are connected directly to wires 208 and 212 at crimps 303. Of course, a soldered or other type connection such as screws could also be used. Further, apertures 304 and 306 replace the cavity of the adapter embodiment. Prong 300 is inserted into aperture 304 and prong 302 is inserted into aperture 306. Preferably, prongs 300, 302 connect to housing 22 and are trapped between housing 22 and end cap 186 so that prongs 300 and 302 cannot move as they are plugged into another receptacle. Male plug 172 is assembled in a similar way as with the adapter embodiment shown in FIGS. 1–9, except that end cap 186 is attached to extension 40 with fasteners 142. Fasteners 142 extend thorough apertures 258 in end cap 186 and connect to extension 40 at threaded apertures 146.

FIGS. 20–23 show an additional embodiment of a plug (generally 600) in accordance with the present invention. Plug 600 includes a housing 602 that houses upper prong 604 and lower prongs 606 and around which wheel 608 is threaded. Cord 610 is connected to the prongs within the housing 602 which may be overmolded as is known in the art around the prongs and cord 610 to create a sealed plug. Housing 602 is provided with a threaded portion 612 over which wheel 608 is threaded. Upper prong 604 is held in place within housing 602 by lug 614 with a ramp 616. As revealed by comparing FIG. 21 (non-clamped) with FIG. 22 (clamped), when wheel 608 is rotated around the threaded portion 612 of the housing 602, it moves along lug 614 and engages ramp 616 so as to cause upper prong 604 to move toward lower prongs 606. When the upper prong 604 has moved toward the lower prongs 606, the plug 600 is in a locked position such that is cannot be easily removed from a socket.

FIGS. 24–27 show yet another embodiment of a plug (generally 600—parts similar to those shown in the embodiment shown in FIGS. 20–24 will be referred to using the same numbers) in accordance with the present invention. In this embodiment, plug 600 includes a housing 602 that houses upper prong 604 in a lug 614 and lower prongs 696 in a base 618. Cord 610 is connected to the prongs within the housing which may be overmolded as is known in the art around the prongs and cord to create a sealed plug. Base 618 includes a groove 620 into which cam 622 of lever 624 is placed. Cam 622 has a flat portion and a rounded portion. When cam 622 is positioned within the groove 620 such that the flat portion thereof faces the underside of lug 614, upper prong 604 is in a standard conventional configuration. As revealed by comparing FIG. 25 (non-clamped) with FIG. 26 (clamped), when lever 624 is moved so that the flat portion of cam 622 no longer faces the underside of lug 614 and the rounded portion of the cam 622 is forced up against the underside of the lug 614, prong 604 is caused to move away from lower prongs 606. When upper prong 604 has moved away from the lower prongs 606, the plug 600 is locked in a position such that it cannot be easily removed from a socket.

Figure 13:
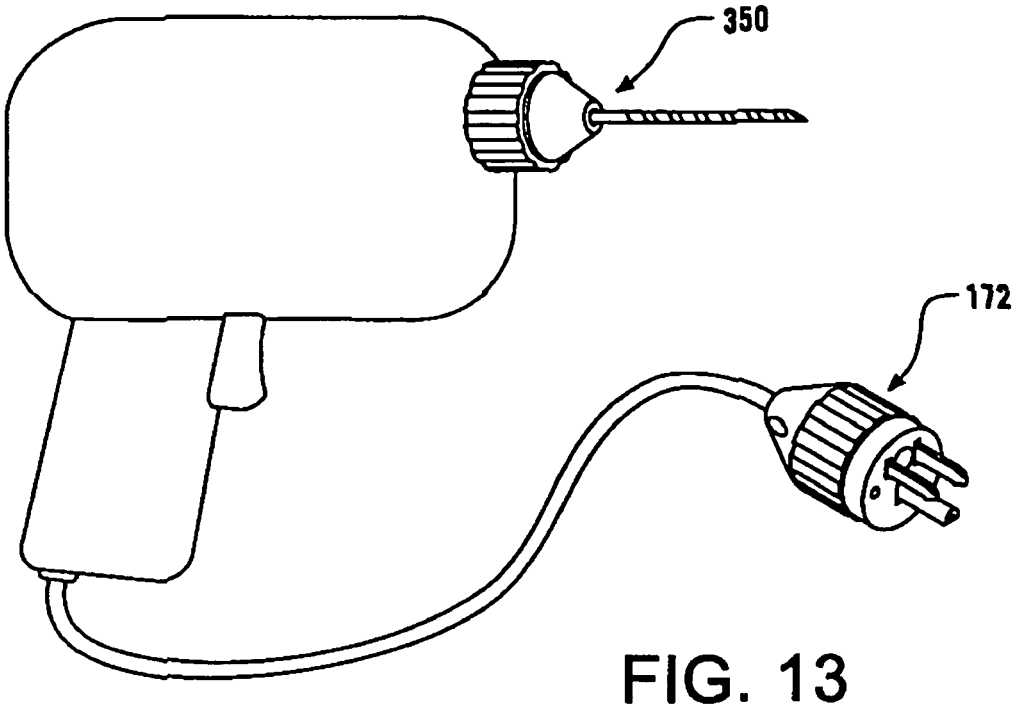
FIG. 13 is a perspective view of the securing device constructed as a hand tool in accordance with one embodiment of the present invention.
Figure 14:
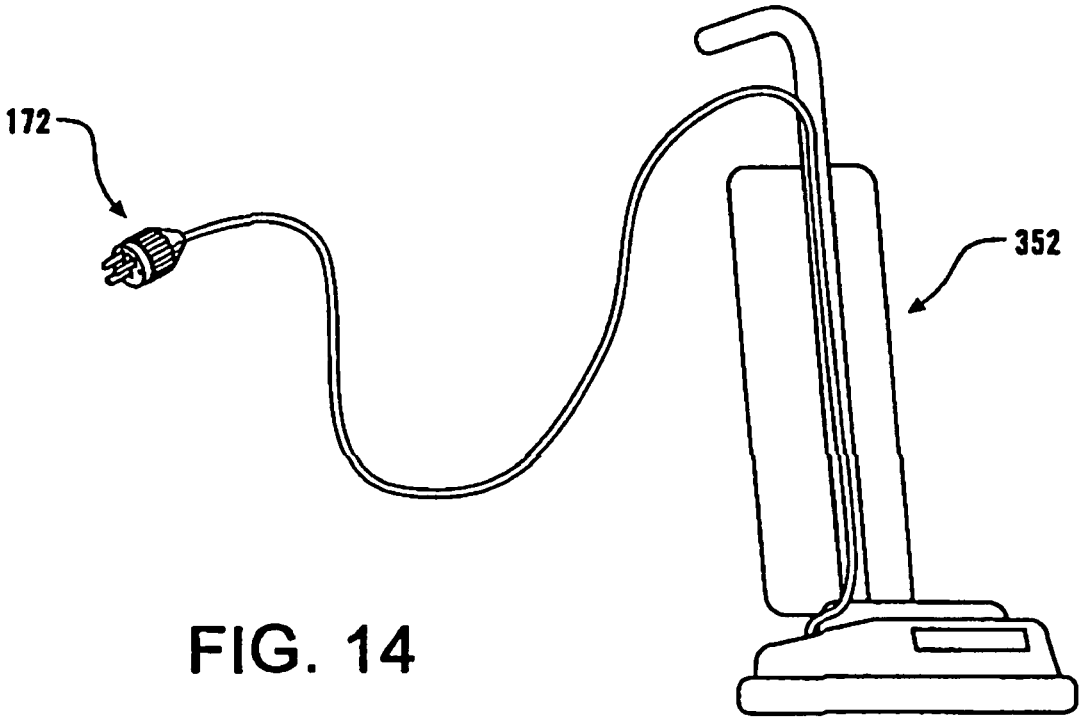
FIG. 14 is a perspective view of the securing device constructed as an appliance in accordance with one embodiment of the present invention.

An assembled male plug is seen in FIG. 13. The male plug 172 is not only useful for an extension cord as shown in FIG. 19, but for attachment to a handheld tool such as drill 350 as shown in FIG. 13, or for attachment to an appliance such as vacuum cleaner 352 as shown in FIG. 14. The attachment of the male plug 172 can be made during the manufacture of a tool or appliance, or post-manufacture. The male (or female plug) of the present invention and shown in FIGS. 10 and 11 can be sold as a replacement kit. The operation of male plug 172 is the same as the operation of the male portion of adapter 20.

Figure 15:
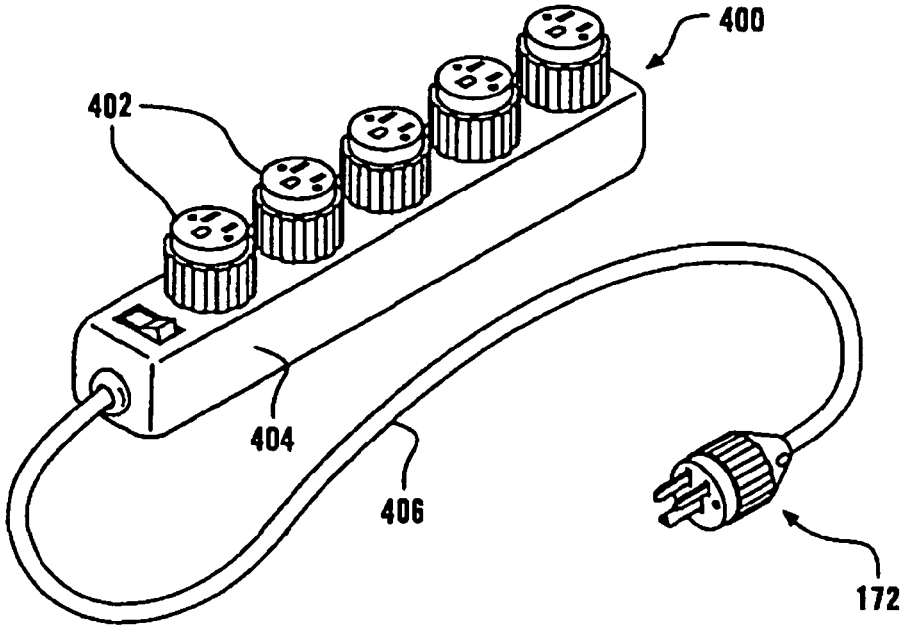
FIG. 15 is a perspective view of the securing device constructed as a power strip in accordance with one embodiment of the present invention.

Another embodiment of the present invention is a surge protector or power strip 400, shown in FIG. 15. Power strip 400 is similar to a conventional power strip except that the male plug is the male plug 172 shown in the embodiment of FIG. 11, and the female receptacles 402 are generally configured like the female receptacle 170 of the embodiment shown in FIG. 10. The primary difference in construction between female receptacle 170 and female receptacle 402 is that there is no end cap 186. Instead, end cap 186 is replaced by a power strip body 404 that is electrically connected to male plug 172 by an electrical cord 406.

Figure 17:
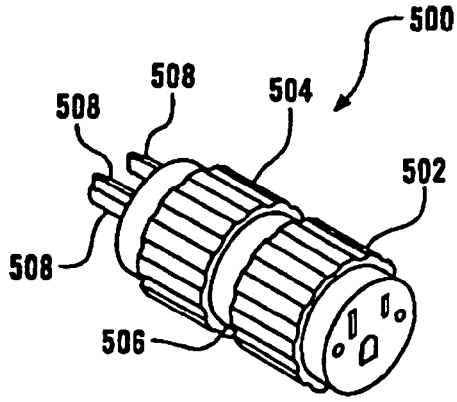
FIG. 17 is a perspective view of the securing device constructed as an adapter in accordance with one embodiment of the present invention.

Yet another embodiment of the present invention is adapter 500, shown in FIG. 17. Adapter 500 is generally constructed in the same manner as the extension cord embodiment, except there is no cord 194, and no end caps 186 on the female receptacle 502 or male plug 504. Plugs 502 and 504 are instead physically connected by a housing member 506 which can be of any length or dimension as appropriate for a particular application, and electrically connected inside by a short length of wire, or by three extended prongs designated as 508 (hot, neutral and ground) made to fit the length of housing 506.

Figure 16:
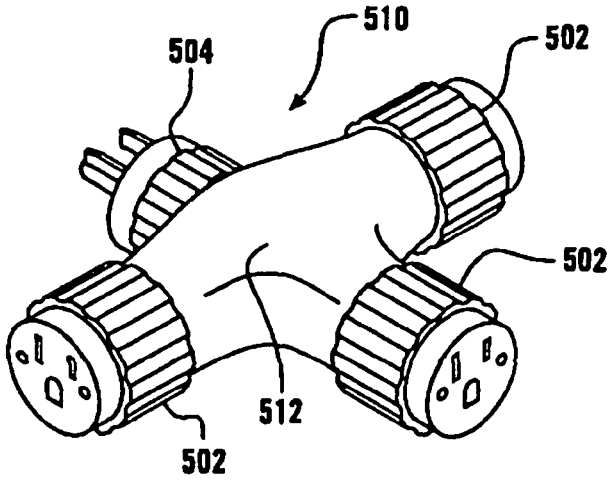
FIG. 16 is a perspective view of the securing device constructed as a multi-access adapter in accordance with one embodiment of the present invention.

Housing 506 can be shaped differently to allow multiple access. One such multi-access adapter 510 has a T-shaped housing 512, as seen in FIG. 16. Of course, housing 512 could be shaped differently to allow more or less female receptacles 502, or to provide access at different angles. Housing 506 or housing 510 could also be jointed (not shown) so the female receptacles and male plug can be adjusted to a wide variety of angles.

Figure 18:
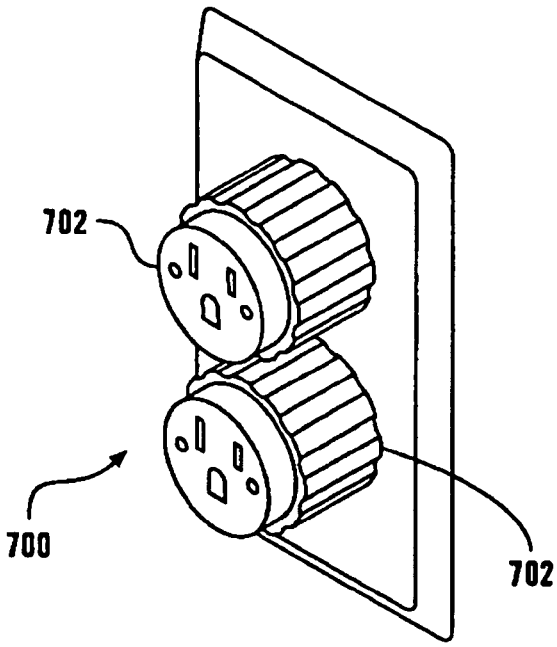
FIG. 18 is a perspective view of the securing device constructed as a wall outlet in accordance with one embodiment of the present invention.

Another embodiment of the present invention is a wall outlet 700, shown in FIG. 18. Wall outlet 700 is constructed from a wall plate having at least one or any number of female receptacles 702 attached thereto. Female receptacles 702 are generally constructed in a manner similar to the female receptacles 402 on the power-strip embodiment shown in FIG. 15.

Figure 30:
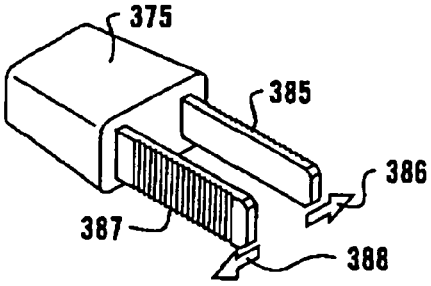
FIG. 30 is a perspective view of a two-prong plug manufactured in accordance with one embodiment of the present invention.
Figure 31:
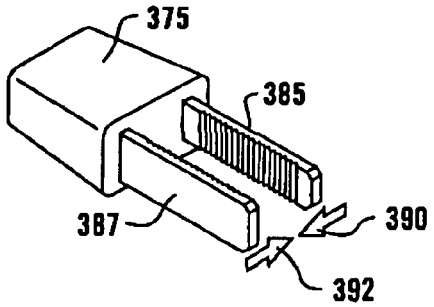
FIG. 31 is a perspective view of a two-prong plug manufactured in accordance with another embodiment of the present invention.
Figure 32:
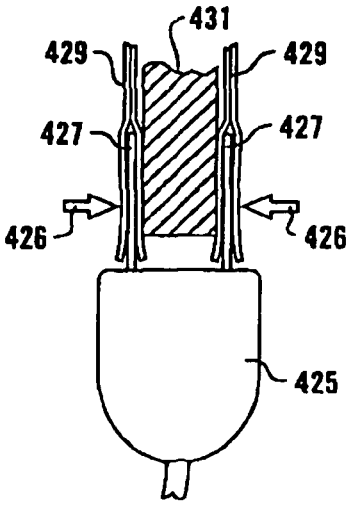
FIG. 32 is a partial cross-sectional view of one embodiment of a socket in accordance with the present invention.
Figure 33:
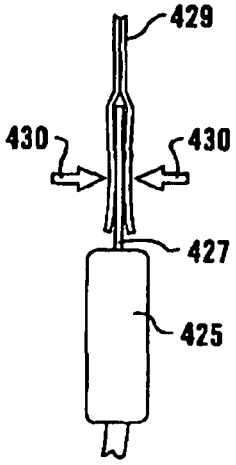
FIG. 33 is a partial cross-sectional view of an alternative embodiment of a socket in accordance with the present invention.
Figure 34:
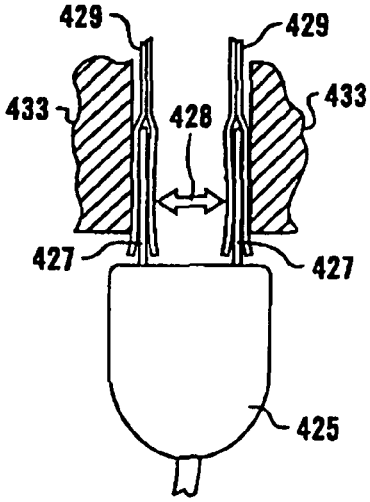
FIG. 34 is a partial cross-sectional view of another embodiment of a socket in accordance with the present invention.

While many particular embodiments of the invention have been discussed in detail herein, FIGS. 28–34 are illustrative of the general concept of the present invention—to provide a securing device to retain the engagement of a plug in a socket using a clamping force. FIGS. 28–31 show generally the concept of the present invention as embodied in a plug and FIGS. 32–34 show generally the concept of the present invention as embodied in a socket. It should be appreciated that the particular embodiments disclosed herein may be adapted and used in connection with a variety of prong numbers and configurations.

Figure 28:
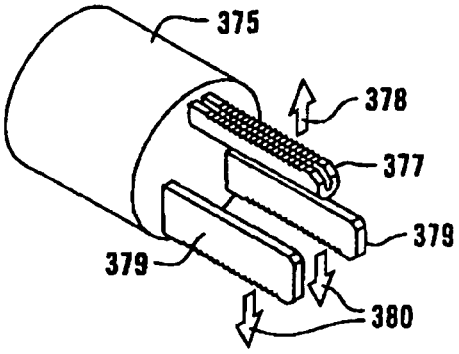
FIG. 28 is a perspective view of a three-prong plug manufactured in accordance with one embodiment of the present invention.
Figure 29:
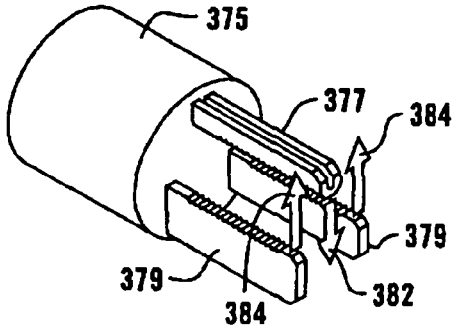
FIG. 29 is a perspective view of a three-prong plug manufactured in accordance with another embodiment of the present invention.

FIGS. 28 and 29 show an embodiment of the plug version of the securing device (identified generally as 375) having three prongs. In FIG. 28, upper prong 377 moves in the direction indicated by arrow 378 away from bottom prongs 379 which move in the direction indicated by arrows 380 away from upper prong 377. The movement of the prongs in opposite directions clamps the plug 375 into a socket. As an alternative to the prong movement shown in FIG. 28, in the embodiment shown in FIG. 29, upper prong 377 moves in the direction indicated by arrow 382 toward bottom prongs 379 which move in the direction indicated by arrows 384 toward upper prong 377. The movement of the prongs toward each other clamps the plug 375 into a socket. In the plugs shown in FIGS. 28 and 29, it would also be possible to provide the clamping force by moving only one of the prongs while keeping the other prongs fixed.

FIGS. 30 and 31 show an embodiment of the plug 375 having two prongs. In FIG. 30, right prong 385 moves in the direction indicated by arrow 386 away from left prong 387 which moves in the direction indicated by arrow 388 away from right prong 385. The movement of the prongs in opposite directions clamps the plug into a socket. As an alternative to the prong movement shown in FIG. 30, in the embodiment shown in FIG. 31, right prong 385 moves in the direction indicated by arrow 390 toward the left prong 387 which moves in the direction indicated by arrow 392 toward the right prong 385. The movement of the prongs toward each other clamps the plug 375 into a socket. In the plugs shown in FIGS. 30 and 31, it would also be possible to provide the clamping force by moving only one of the prongs while keeping the other prong fixed.

FIG. 32 shows an embodiment of the socket into which a two-pronged plug 425 may be inserted. In this embodiment, after the prongs 427 of the plug 425 are inserted into sleeves 429, a force is applied to the sleeves 429 in the directions indicated by arrows 426 so as to apply a clamping pressure to the sleeves 429 around interior member 431.

FIG. 33 shows and embodiment of the socket into which a one-pronged plug 425 may be inserted. In this embodiment, after the prong 427 is inserted into sleeve 429, forces are applied to the sleeve 429 in the directions indicated by arrows 430 so as to apply a clamping pressure to the sleeve 429. As an alternative to the clamping force directions shown in FIG. 33, a clamping force could be provided on one side of the sleeve 429 with the other side of the sleeve held in place.

Like the socket embodiment of FIG. 32, FIG. 34 shows an embodiment of the socket into which a two-pronged plug 425 may be inserted. However, in this embodiment, after the prongs 427 of the plug 425 are inserted into the sleeves 429, a force is applied to the sleeves 429 in the directions indicated by arrows 428 so as to apply a clamping pressure to the sleeves 429 against exterior member 433.

Although the invention has been herein shown and described in what is perceived to be the most practical and preferred embodiments, it is to be understood that the invention is not intended to be limited to the specific embodiments set forth above. For example, the prongs shown on or received by the embodiments of the present invention can be of different configurations to fit standards of different countries or for specialized industrial equipment. Further, there may be a different number of prongs than is shown in the described embodiments. Accordingly, it is recognized that modifications may be made by one skilled in the art of the invention without departing from the spirit or intent of the invention and therefore, the invention is to be taken as including all reasonable equivalents to the subject matter of the appended claims.

I claim:

1. A securing device for receiving an outside prong, the securing device comprising:

a housing, the housing having an aperture therein and a rotatable collar positioned thereon;

a conductive sleeve positioned within a channel of the housing adjacent the aperture and capable of receiving the outside prong; and a slide member positioned on an outer side of the housing adjacent the sleeve, the slide member functionally engaged to the rotatable collar and slidingly moveable with respect to the housing, such that actuation of the rotatable collar causes the slide member to slidingly engage a ramp extending outwardly from the sleeve so as to clamp the outside prong within the sleeve when the outside prong is received within the housing;

wherein the sleeve positioned within the housing is electrically connected to a wire.

2. The securing device of claim 1 further comprising a second sleeve positioned within the housing adjacent a second aperture and capable of receiving a second outside prong, the slide member being moveable with respect to the housing to engage a second ramp protruding from the second sleeve so as to clamp the second outside prong when the second outside prong is received within the housing.

3. The securing device of claim 2 wherein the second sleeve positioned within the housing is electrically connected to a second wire.

4. The securing device of claim 3 further comprising a ground connector positioned within the housing adjacent a third aperture and capable of receiving a ground prong, the ground connector electrically connected to a third wire.

* * * * *